United States Patent [19]

Donnadille

[11] 3,963,935

[45] June 15, 1976

[54] SHUTTER DESIGNED TO BLOCK HIGH-ENERGY PARTICLE BEAMS

[75] Inventor: Bernard Donnadille, Paris, France

[73] Assignee: C.G.R.-Mev., Paris, France

[22] Filed: Apr. 4, 1975

[21] Appl. No.: 565,137

[30] Foreign Application Priority Data

Apr. 9, 1974 France ..... 74.12472

[52] U.S. Cl. ..... 250/514

[51] Int. Cl.[2] ..... G21F 5/04; G21K 1/02

[58] Field of Search ..... 250/505, 514, 515

[56] References Cited

UNITED STATES PATENTS

| | | | |
|---|---|---|---|
| 3,384,751 | 5/1968 | Sperry | 250/514 |
| 3,721,826 | 8/1970 | Thomas, Jr. | 250/514 |

*Primary Examiner*—Archie R. Borchelt
*Assistant Examiner*—T. N. Grigsby
*Attorney, Agent, or Firm*—Cushman, Darby & Cushman

[57] ABSTRACT

A shutter designed for temporarily closing off an opening $O_A$ formed in the wall P of an irradiation room, for the passage of a particle beam, comprises a cylindrical metal block K which can rotate about its axis XX and occupy two stable position which are 180° from one another. The block K a cylindrical cage closed at its two ends by two circular plates equipped respectively with eccentric holes for the passage of the particle beam, the eccentric holes having axes YY parallel to the axis XX and located at an interval L therefrom -The block K is provided with a longitudinal passage through which there can pass the particle beam and a blind hole or "pit" disposed symmetrically to the longitudinal passage and which can block the particle beam according as the positioning of the block K by respect with the eccentric holes.

5 Claims, 4 Drawing Figures

SHUTTER DESIGNED TO BLOCK HIGH-ENERGY PARTICLE BEAMS

Irradiation devices using particle accelerators, generally comprise several irradiation rooms into which, simultaneously or otherwise, the irradiation beams penetrate.

The irradiation rooms as well as the room in which the accelerator is located, have thick concrete walls to provide efficient protection against any unwanted irradiation and leackage radiation.

When irradiation rooms of this kind are not in use, the safety aspect requires that permanent monitoring of the absence of all irradiation there is necessary. To do this, certain precautions must be taken and in particular the opening formed in the irradiation room for the passage of the particle beam must be closed off completely by means of a shutter whenever the room is not in use.

The object of the present invention is a shutter of this kind.

In accordance with the invention, a shutter for a high-energy particle beam, making it possible to close off an opening formed in a wall of a given thickness, comprises a metal block K of cylindrical form having an axis XX and having radius R said block K being equipped at each of its ends and on the axis XX, with pivots, said block K being arranged in a cylindrical metal cage closed at its ends respectively by a first plate and by a second plate, each of said plates being equipped with a central hole in which there can engage one of said pivots of said block K, and respectively with eccentric holes disposed mutually opposite one another and having a common axis YY parallel to the axis XX of said central hole and located at an interval L therefrom, said cylindrical block K containing a longitudinal passage of cylindrical form having a diameter d and an axis $Y_1Y_1$ parallel to said axis XX located at an interval L from the latter, said cylindrical block K containing a blind hole, referred to as a "pit," of diameter substantially equal to the diameter d of said longitudinal passage and having an axis $Y_2Y_2$ parallel to that XX and symmetrical with the axis $Y_1Y_1$ in relation to said axis XX, the distance L being chosen in such a fashion that the relationship:

$$\frac{d}{2} < L < R - \frac{d}{2}$$

is satisfied.

For a better understanding of the inventions and to show how the same may be carried into effect, reference will be made to the drawings, given solely by way of example, which accompany the following description, and wherein.

Figure 1:
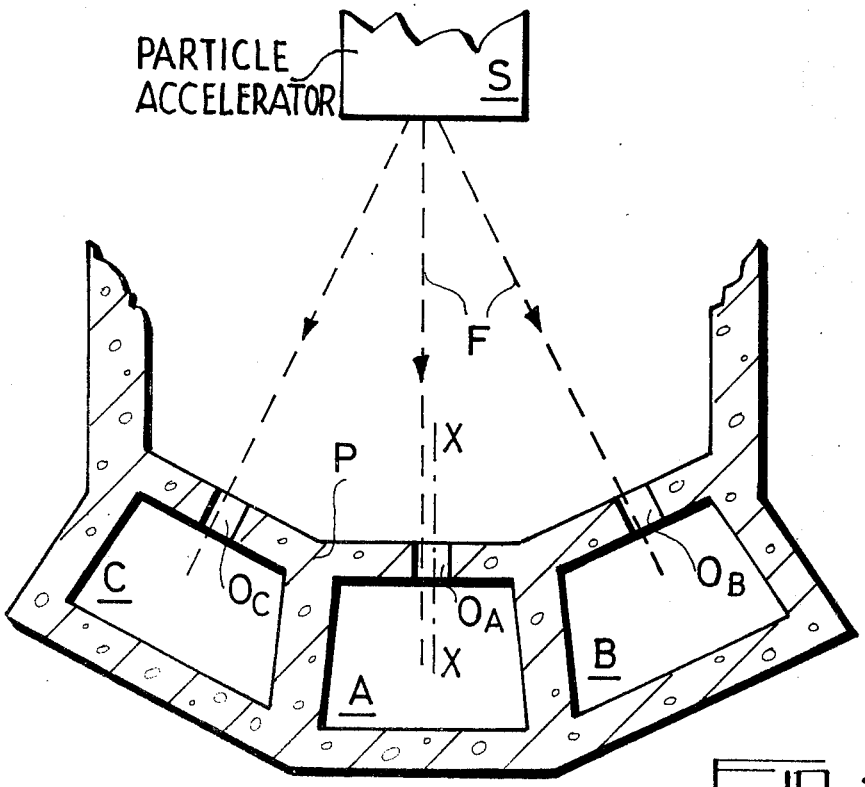
FIG. 1 illustrates an example of an irradiation device utilising high-energy particle beams.

The medical irriation device shown in FIG. 1 comprises a particle accelerator S producing a beam F of high-energy particles which can be directed into one of the treatment rooms A, B and C through corresponding openings $O_A$, $O_B$, $O_C$ forming in the walls P of said rooms A,B,C.

When a room (or several rooms) is not in use, the corresponding opening must be closed off as a safety measure in order to prevent any accidental irradiation due operational defects in the irradiation system.

Each of the openings $O_A$, $O_B$, $O_C$ can be equipped with a shutter in accordance with the invention.

Figure 3:
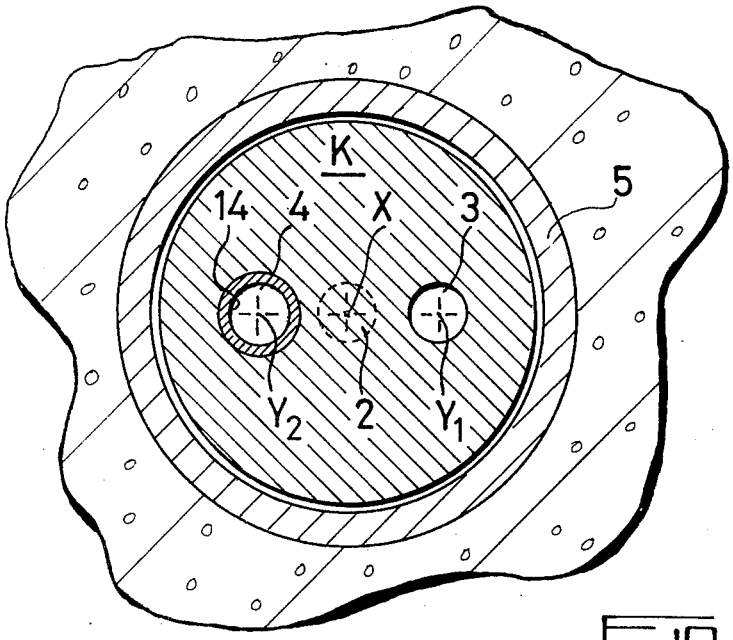
FIGS. 2, 3 illustrate in longitudinal section and in transverse section, an embodiment of a shutter in accordance with the invention.
Figure 2:
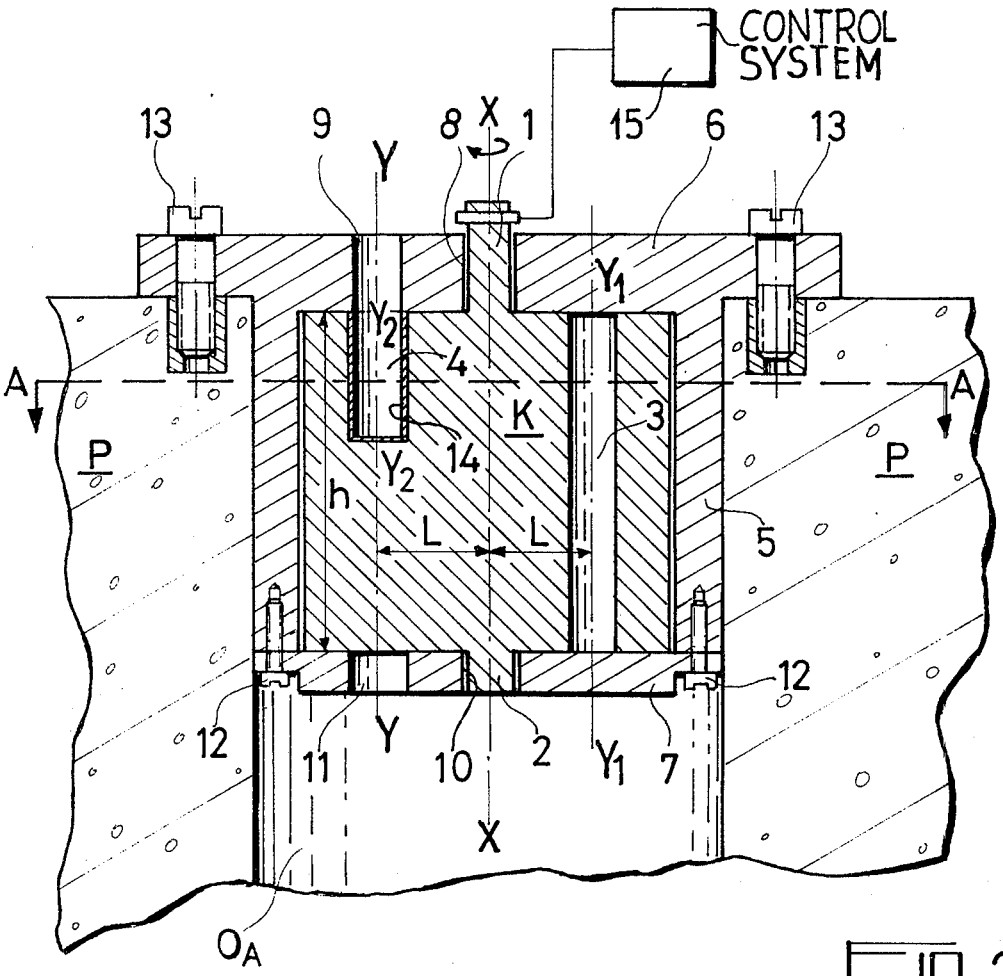

This shutter, illustrated in longitudinal section in FIG. 2 and in transverse section in FIG. 3, comprises a cylindrical metal block having an axis XX, the block K being provided with pivots 1 and 2 at the centre of each of its ends.

The clindrical block K, having a radius R, moreover comprises:

- a longitudinal passage 3 of cylindrical shape, whose axis $Y_1Y_1$ is located at an interval L from the axix XX and parallel thereto, as FIG. 2 shows;
- a blind hole or "pit" 4 of cylindrical form, having a diameter d and an axis $Y_2Y_2$ parallel to that XX and at an interval from the latter, such that:

$$\frac{d}{2} < L < R - \frac{d}{2}$$

The block K is arranged in the cylindrical metal cage 5 closed off at its ends by a first plate 6 and a second plate 7. The first plate 6 is equipped with a central hole 8 in which the pivot 1 can engage, and an eccentric hole 9 of cylindrical shape with an axis YY parallel to the axis XX of the block K and at an interval L from this axis XX. The second plate 7 is provided with a central hole 10 in which the pivot 2 of the block can engage, and an eccentric cylindrical hole 11 having an axis YY. The eccentric holes 9 and 11 have diameters substantially equal to the diameter d of the longitudinal passage 3 and the "pit" 4 in the block K, which can move about its axis XX, can occupy two stable positions which are at 180° from one another (open position and closed position of the shutter), the position of the shutter being determined by a control system 15 (FIG. 2) associated with a deflection system (not shown in FIG. 1) for the particle beam F. These two positions correspond respectively to a situation in which the axis YY of the eccentric holes in the plates 6 and 7, coincides with the axis $Y_1Y_1$ of the passages 3 (and this corresponds to the open position of the shutter), or with the axis $Y_2Y_2$ of the "pit" 4 (closed position of the shutter, as shown in FIG. 2).

In the example shown in FIG. 2, the second plate 7 is detachable, screws 12 making it possible to attach this plate 7 to the cage 5 when the block K is introduced into the cage. The first circular plate 6 has a larger diameter than the external diameter of the cylindrical cage 5 to which it is attached, and this enables it to be fixed (by means of screws 13 for example) to the wall P of each irradiation room after positioning each of shutters within the corresponding opening $O_A$, $O_B$, $O_C$.

FIG. 3 illustrates a transverse section on the line AA through a shutter in accordance with the invention.

In the example shown in FIG. 2, the block K and the cage 5 are made of steel and the internal wall of the "pit" 4 is covered with an absorptive material 14, cadmium for example. This "pit" 4, of cylindrical form, has a flat base perpendicular to the axis $Y_2Y_2$.

Figure 4:
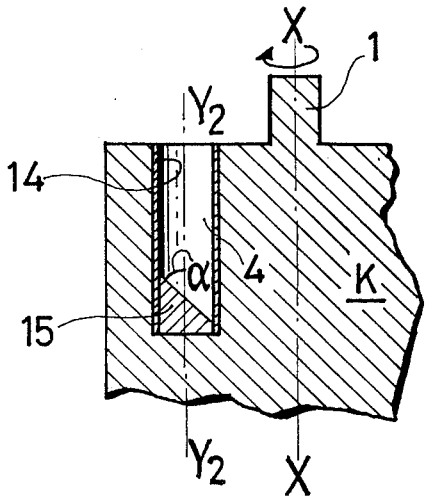
FIG. 4 illustrates another embodiment of a shutter in accordance with the invention.

In the embodiment shown in FIG. 4, the base of the "pit" 4 makes an angle $\alpha$ with the axis $Y_2Y_2$, which differs from 90°. A cylindrical core 15 (for example cadmium), which has been chamfered, is introduced into the "pit" 4 with the flat base, in order to produce a "pit" whose base is inclined in in relation to the axis $Y_2Y_2$.

The depth of the "pit" 4 is determined as a function of the energy of the particles in the irradiating beam. It may also be equal to a third of the height h of the block K, this height h is generally less than thickness of the wall P in which the opening $O_A$ is to be closed.

What I claim is:

1. A shutter for a high-energy particle beam, which makes it possible to close off an opening formed in a wall of a given thickness, comprising a metal block K of cylindrical form having a radius R and an axis XX, said block K being equipped at each of its ends and on the axis XX, with pivots, said block K being arranged in a cylindrical metal cage closed at its ends respectively by a first plate and by a second plate, each of said plates being equipped with a central hole in which there can engage one said pivots of the block K, and with an eccentric hole, said eccentric holes being disposed mutually opposite one another and having a common axis YY parallel to the axis XX of said central hole located at an interval L therefrom, said cylindrical block K being provided with longitudinal passage of cylindrical form, having a diameter d and axis $Y_1Y_1$ parallel to said axis XX and located at an interval L from the latter, and also containing a blind hole, referred to as a "pit,"having a diameter substantially equal to said diameter d and having an axis $Y_2Y_2$ parallel to said axis XX and symmetrical with said axis $Y_1Y_1$ in relation to said axis XX, said distance L being chosen in such a fashion that the relationship:

$$\frac{d}{2} < L < L - \frac{d}{2}$$

is satisfied.

2. A shutter as claimed in claim 1, wherein said "pit" is covered with an absorptive material on its internal wall.

3. A shutter as claimed in claim 1, wherein said block K, said cage and said plates are made of steel.

4. A shutter as claimed in claim 1, wherein said block K is associated with a control system which enables it to occupy two stable positions, which are at 180° from one another and correspond respectively to coincidence between the axis YY of the eccentric holes in said first and second plates, and the axis $Y_1Y_1$ of said longitudinal passage and said axis $Y_2Y_2$ of said "pit."

5. A shutter as claimed in claim 1, wherein said "pit" has a depth equal to one third of the height of said block K.

* * * * *